US006000099A

United States Patent [19]

Brückner et al.

[11] Patent Number: 6,000,099

[45] Date of Patent: Dec. 14, 1999

[54] HINGE PART FOR MOUNTING A MOTOR VEHICLE DOOR ON A MOTOR VEHICLE BODY

[75] Inventors: Lothar Brückner, Leonberg; Peter Mrowka, Remscheid, both of Germany

[73] Assignee: Ed. Scharwächter GmbH, Remscheid, Germany

[21] Appl. No.: 09/067,503

[22] Filed: Apr. 27, 1998

[30] Foreign Application Priority Data

Apr. 24, 1997 [DE] Germany ..... 197 17 250

[51] Int. Cl.[6] ..... E05D 3/06

[52] U.S. Cl. ..... 16/366; 16/387; 16/372

[58] Field of Search ..... 16/366, 387, 372, 16/368–370, 221, 225, 226, 385

[56] References Cited

U.S. PATENT DOCUMENTS

| | | | |
|---|---|---|---|
| 3,949,445 | 4/1976 | Stevens | 16/262 |
| 5,012,556 | 5/1991 | Precht et al. | 16/366 |
| 5,613,541 | 3/1997 | Bradbury | 160/232 |
| 5,685,046 | 11/1997 | Neag et al. | 16/366 |

FOREIGN PATENT DOCUMENTS

| | | | |
|---|---|---|---|
| 577535 | 1/1994 | European Pat. Off. | 16/366 |
| 3134743 | 6/1982 | Germany | 16/366 |
| 664574 | 1/1952 | United Kingdom | 16/366 |

*Primary Examiner*—Chuck Y. Mah
*Attorney, Agent, or Firm*—Brown & Wood, LLP

[57] ABSTRACT

A hinge part for attachment of a motor vehicle door and including a hinge part body formed of a thin-walled hollow extruded section having at least three chambers, and two pairs of hinge gudgeon provided on opposite sides of the hinge part body for mounting the hinge part on the motor vehicle body for rotation about two, spaced from each other, pivot axes.

16 Claims, 3 Drawing Sheets

HINGE PART FOR MOUNTING A MOTOR VEHICLE DOOR ON A MOTOR VEHICLE BODY

BACKGROUND OF THE INVENTION

1. Field of the Invention

The present invention relates to a hinge part for mounting a motor vehicle door and, in particular, a door which is mounted on a motor vehicle body for pivotal movement about two, spaced from each other, pivot axes with a hinge part provided with two pairs of hinge gudgeons.

2. Description of the Prior Art

The hinge parts of this type are used usually for mounting motor vehicles doors the pivotal movement of which is combined with a transverse movement, and which are connected with a door pillar for pivotal movement about a first pivot or hinge axis and are connected with the door for pivotal movement about a second pivot or hinge axis. At that, both the door pillar and the door are provided with respective hinge halves or hinge flaps, which are formed as separately mountable locking or bracing parts. The hinge part is pivotally connected with both hinge halves or hinge flaps with respective hinge pins. From this arrangement of the hinge part, it follows that at least at the beginning of the opening movement of a motor vehicle door, the hinge part serves as a support for the vehicle door. To perform this additional function, the hinge part must have a certain flexural strength, to keep the sinking of the vehicle door during its opening within certain limits. Likewise, the hinge part should have an adequate torsional resistance to insure a predetermined movement path of the door during the course of its opening or closing.

A hinge part of the above-discussed type for a motor vehicle door, which is mounted on a motor vehicle body with two, vertically spaced from each other, pairs of hinges, is disclosed in German Publication DE-OS 42 37 060. The hinge part disclosed in this German Publication is formed as a shaped, hollow box support with two hinge halves provided at its free ends for attachment to a vehicle door and a door pillar. This hinge part is constructively characterized in that it is formed of two opposite bulged sheet metal shells connected with each other by spot welding. This construction of the hinge part, while insuring mounting of a door, in which the pivotal movement is combined with transverse movement, comparable with the previously used hinge parts, permits to substantially reduce the weight of the door assembly and a certain reduction of costs associated with mounting of the door. However, the manufacturing costs of this hinge part, which is formed of two sheet metal half-shells welded with each other, are rather high. On the other hand, manufacturing of a hinge part from two separate sheet metal pressed workpieces is associated with an increased scattering of tolerances. In additional, mounting is somewhat complicated by a necessity to provide auxiliary parts for connecting the hinge part with the door pillar and the door, which is associated with a necessity to insure an additional tolerance compatibility.

Accordingly, an object of the present invention is to provide a hinge part of the above-discussed type which would have a greater stability, in particular a greater flexural strength, and a greater resistance to deformation in comparison with prior art hinge part.

Another object of the present invention, is to provide a hinge part of the above-described type which would have a substantially reduced weight.

A further object of the present invention is to provide a hinge part of the above-described type which would insure an easy connection of pre-fabricated hinge gudgeons.

SUMMARY OF THE INVENTION

This and other objects of the present invention, which will become apparent hereinafter, are achieved by providing a hinge part a body of which is formed of a thin-walled hollow extruded section having at least three chamber. The advantage of using a hinge part formed of an extruded section consist in that the stress, which primarily influences the flexural strength and the torsional resistance, is controlled with a smallest possible expenditure of material for the hinge part, resulting in a smallest possible weight of it. Further, the use of a hollow extruded section instead of conventional box-shaped part of sheet material section eliminates to a most possible extent, practically completely, the problems associated with tolerances. Still further, the use of a hollow extruded section permits to easily adapt the hinge part to different loads applied thereto simply by changing the chamber cross-sections. The present invention offers a possibility to adapt a hinge part to each possible load, which may occur, by simply changing the part dimensions. Further, in addition to reduction of weight resulting from the use of a hollow extruded section, a further weight reduction can be achieved by using light metals, e.g., aluminum.

According to a preferred embodiment of the present invention, it is provided that the outwardly located chambers of the hinge part, which is made of at least one hollow extruded section with at least four chambers, have a cross-section suitable for attachment of the hinge gudgeons, and that the two inner chambers have a height exceeding that of the other chambers. For the sake of the symmetry of the construction, the hollow extruded section should have at least three inner chambers, with the middle chamber having advantageously a height smaller than the two adjoining chambers.

According to a further preferred embodiment of a hinge part formed of a hollow extruded section, it is provided that the section extends transverse to the hinge axes of the hinge part.

It can further be contemplated to form the body of the hinge part of a hollow extruded section having at least three inner and two outwardly located chambers, with the inner chambers having isometric shapes, with the outwardly located chambers having a square cross-section, with all of the inner chambers having a rectangular cross-section, and with the middle one of the inner chambers having a height smaller than the height of the adjoining two other inner chambers.

To provide for a larger distance between two hinge gudgeons defining the two hinge axes of a hinge part formed of a hollow extruded section, the hinge part body can be so arranged that it extends parallel to the hinge axes. When the body of the hinge part extends parallel to or is slightly inclined to the hinge axes of the hinge part, it is advantageous to use a hollows extruded section including three inner chambers of an equal size.

Independent on whether the hinge part body extends transverse to or parallel to the hinge axes of the hinge part, it is advantageously contemplated to mount the hinge gudgeons in both outwardly located chambers, with the hinge gudgeons being formed of shaped parts provided each with a gudgeon bore.

When the hinge part body, i.e., the hollow extruded section extends parallel to the hinge axes of the hinge part, it is advantageously contemplated to form cut-outs in the two outwardly located chambers between respective, located one above the other, gudgeons along the height of the hinge part, with the hinge gudgeons being formed as profiled bodies with hinge gudgeons bore and inserted into free-cut regions of the two outwardly located chambers. The hinge gudgeon forming bodies can be formed as solid shaped parts provided with gudgeon bores or be formed as sections of a tubular material and the like.

Dependant on whether the hinge gudgeons are formed as solid push-in bodies, or as sections of a tubular material, or as sections of another hollow profile, the hinge gudgeons can be secured in their corresponding chambers of the hollow extruded sections by screw means or by welding and, if necessary, by form-locking deformation, in particular by caulking.

When the hinge part body, i.e., the hollow extruded section extends parallel to or at an acute angle to the hinge axes of the hinge part, the hinge gudgeon can be secured to circumferential walls of the outwardly located chambers, e.g., by welding.

According to a further development of the present invention, when the hinge part body, i.e., the hollow extruded section extends parallel to the hinge axes of the hinge part, the outwardly located chambers of the hollow extruded section can be formed with a cross-section corresponding to a hinge gudgeon bore, with the hinge gudgeons being formed by suitable free-cuts in the respective outwardly located chambers. At that, it can be provided that the outwardly located chambers have a width smaller than the width of the inner chambers.

According to a still further embodiment of the present invention, when the hinge part body, i.e., the hollow extruded section extends transverse to the hinge axes of the hinge part, the hinge part body can be symmetrically narrowed inward along its height in the region between the two outwardly located chambers.

BRIEF DESCRIPTION OF THE DRAWINGS

The features and objects of the present invention will become more apparent, and the invention itself will be best understood from the following detailed description of the preferred embodiments when read with reference to the accompanying drawings, wherein.

DETAILED DESCRIPTION OF THE PREFERRED EMBODIMENTS

Figure 1:
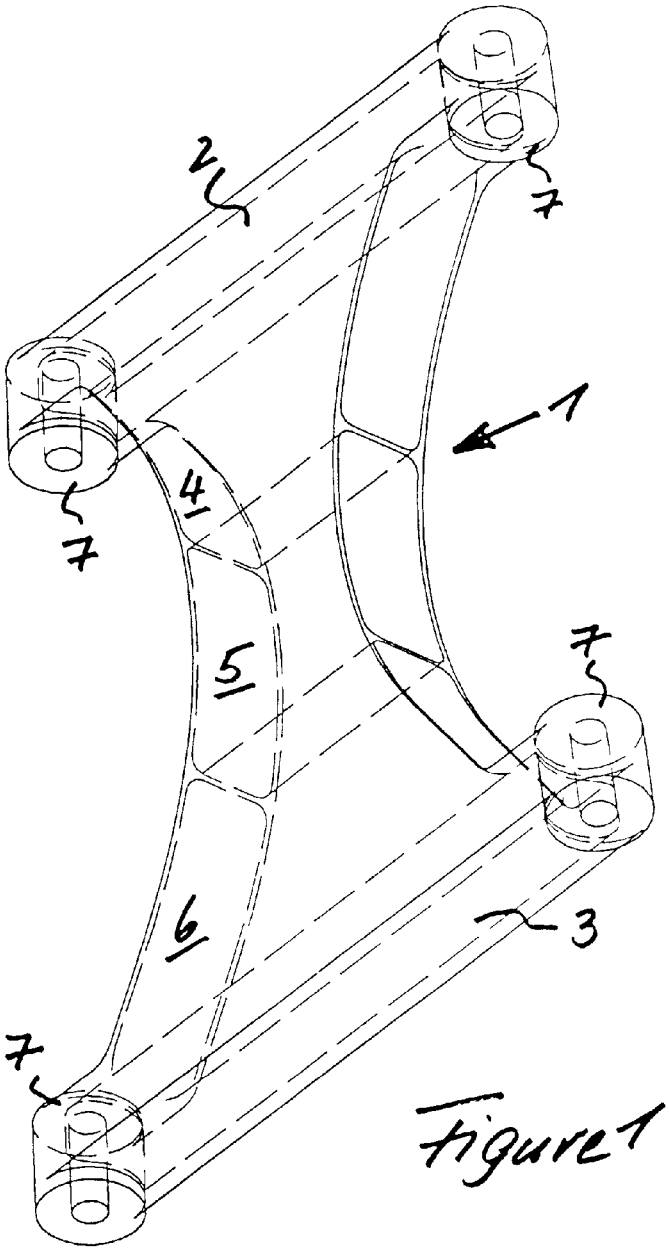
FIG. 1 shows a schematic view of a first embodiment of a hinge part according to the present invention for a motor vehicle door mountable for a pivotal movement about two, spaced from each other, pivot axes.

A hinge part according to the present invention, which is shown in the drawings, is used for mounting motor vehicle doors with a pivotal movement which is combined with a transverse movement. At that, the hinge part rotates about a first pivot axis associated with a door pillar, not shown in the drawing and about a second axis associated with the door likewise not shown in the drawings.

Figure 2:
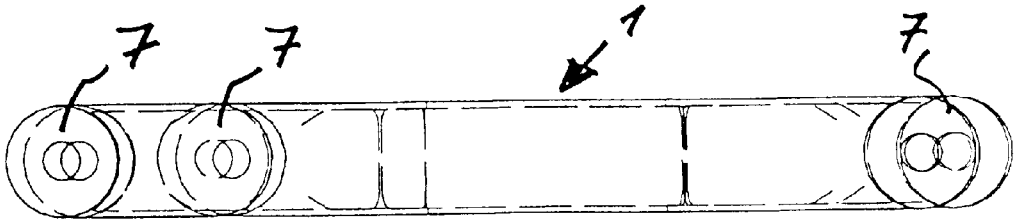
FIG. 2 shows a plan view of the hinge part shown in FIG. 1.

A hinge part 1, which is shown in FIGS. 1 and 2 is formed of a thin-walled hollow extruded section which extends transverse to both pivot axes. In the embodiment shown in the drawings, the hollow extruded section, which forms the hinge part 1, includes five chambers. Two chambers 2 and 3, which are located outwardly, have a substantially square cross-section. The three inner chambers 4, 5, 6 have a substantially rectangular cross-section. At that, the middle chamber 5 has a smaller height than the chambers 4 and 6 located on opposite side of the middle chamber 5.

The hinge part 1 is connected to the door pillar and the door by respective pairs of hinge gudgeons 7 which are formed as shaped pieces, with each pair of hinge gudgeons 7 serving as a hinge half. The hinge gudgeons 7 of each pair are welded to opposite ends of a respective outwardly located chamber 2 or 3. The hinge part 1, which, is shown in FIGS. 1 and 2 is characterized in that the hollow extruded section, which forms the hinge part 1, is provided, at its opposite sides along its height, with two symmetrical, with respect to its middle, substantially arcuate cut-outs. At that, as it particularly shown in FIG. 2, there is provided an offset with respect to at least one pair of hinge gudgeons 7, which extends transverse to the vertical extent of the hinge part 1.

Figure 3:
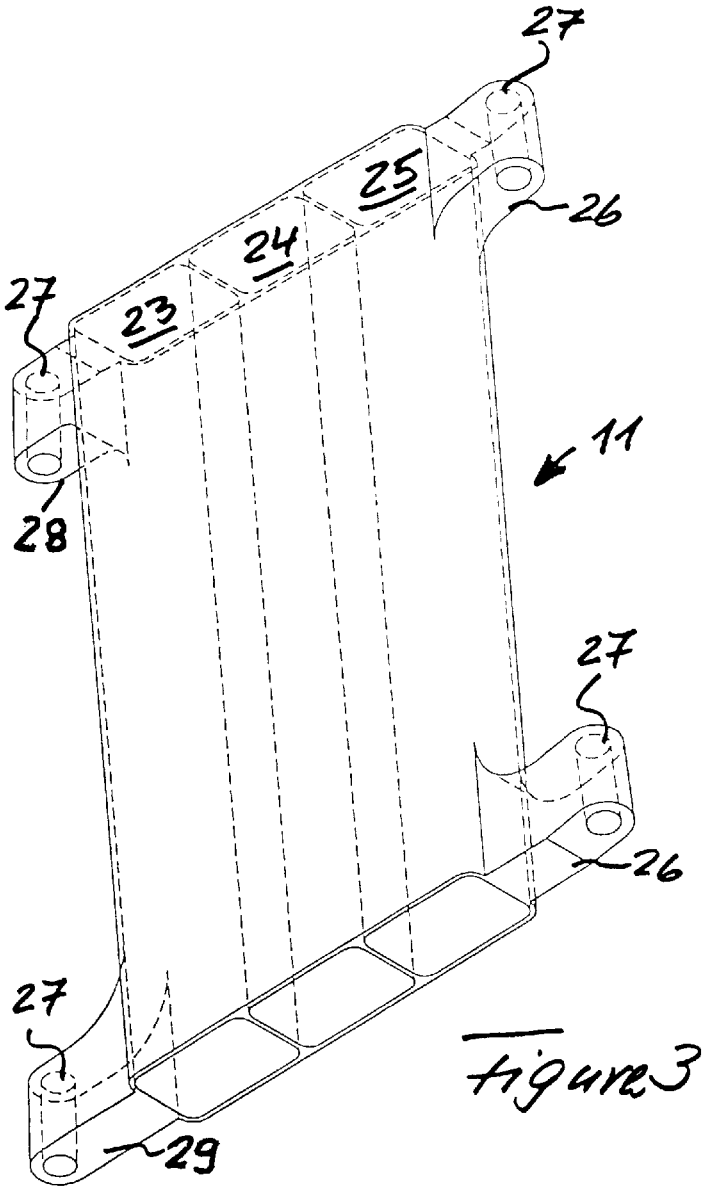
FIG. 3 shows a schematic view of a second embodiment of a hinge part according to the present invention for a motor vehicle door mountable for a pivotal movement about two, spaced from each other, pivot axes.
Figure 4:
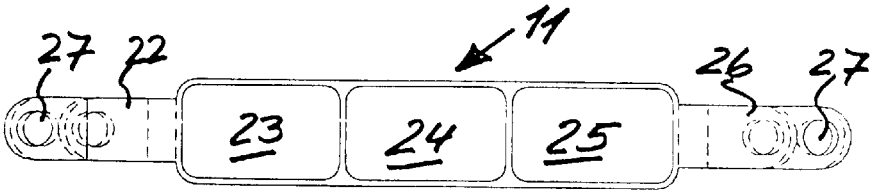
FIG. 4 shows a plan view of the hinge part shown in FIG. 3.

A hinge part 11 according to a second embodiment of the present invention, which is shown in FIGS. 3 and 4, likewise is formed as a thin-walled hollow extended section which extends parallel to its both pivot axis. The hinge part 11, as the hinge part 1, has five chambers 22, 23, 24, 25, 26. The two outwardly located chambers 22 and 26 has, in comparison with the inner chambers 23, 24 25, a reduced width, with their inner width corresponding to a diameter of a hinge gudgeon bore 27. The two outwardly located chambers 22 and 26 are cut out on opposite sides of the hinge part 11 over a corresponding height to form two pairs of gudgeons 28 and 29, with the cut-outs being so made that the gudgeons 28 and 29 are located in the regions of the upper and lower ends of the hinge part 11, respectfully.

Figure 5:
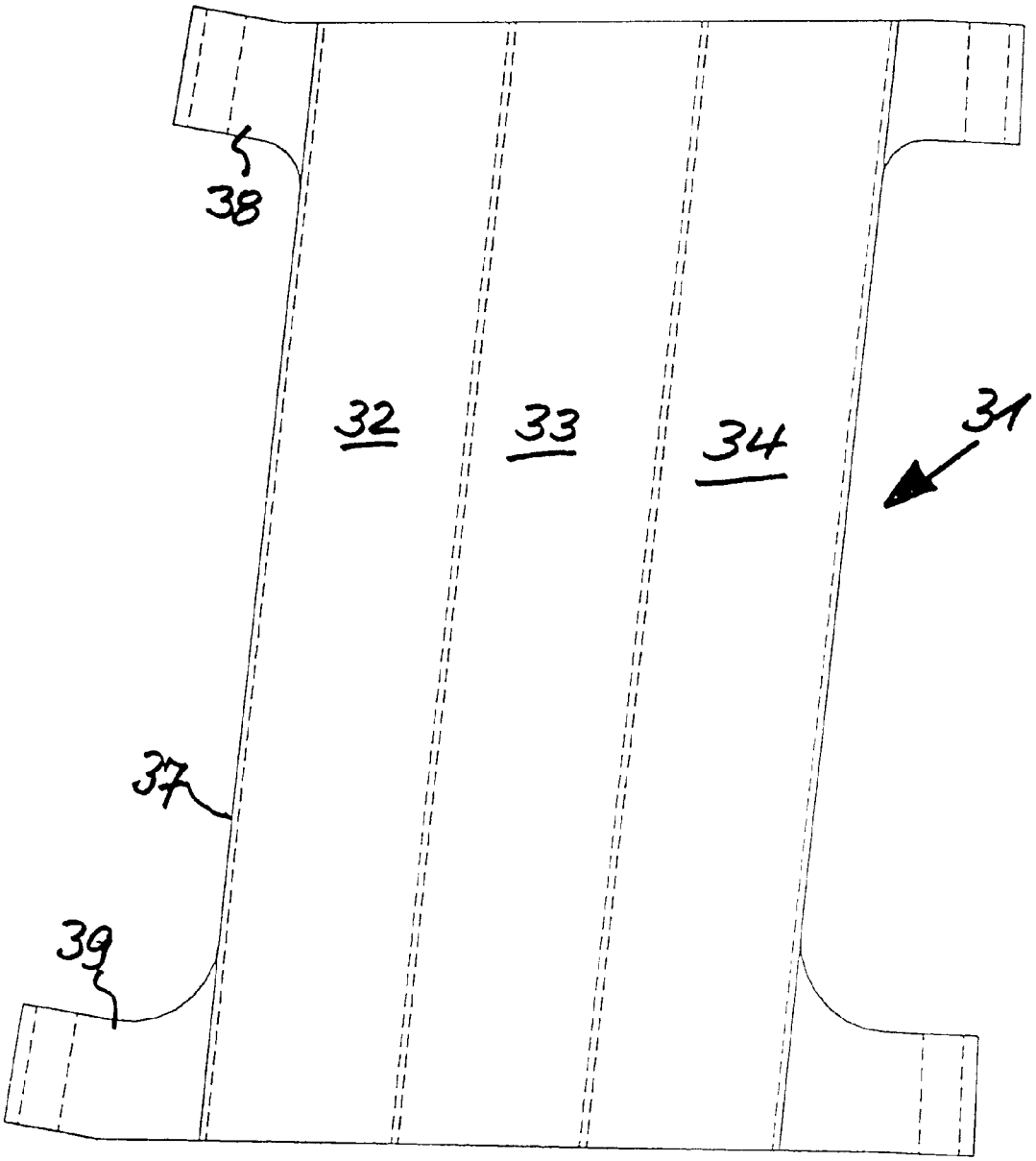
FIG. 5 shows a side view of a modified embodiment of the hinge part shown in FIG. 3.

Finally, a hinge part 31, which is formed in accordance with the third embodiment of the present invention and is shown in FIG. 5, is also formed of a thin-walled hollow extruded section which extends at an acute angle with respect to both axes. The hollow extended section, which forms the hinge part 31, includes three chambers 32, 33, 34 of equal size. Hinge gudgeons 38 and 39 extend at an angle toward the vertical direction and are attached to respective opposite outer side walls 37 of the outwardly located chambers 32, 34 by an appropriate conventional attachment method such as screwing, welding, or form-locking deformation, preferably, caulking.

Through the present invention was shown and described with references to the preferred embodiments, various modifications thereof will be apparent to those skilled in the art and, therefore, it is not intended that the invention be limited to the disclosed embodiments or details thereof, and departure can be made therefrom within the spirit and scope of the appended claims.

What is claimed is:

1. A hinge part for attachment of a motor vehicle door to a motor vehicle body, comprising:

a hinge part body rotatable about a first pivot axis associated with a door pillar provided in the motor vehicle body and a second pivot axis associated with the motor vehicle door, the hinge part body being formed of a thin-walled hollow extruded section having at least three chambers located adjacent to each other; and to pairs of hinge gudgeons provided on opposite longitudinal sides of the hinge part body for pivotally attaching the hinge part to the door pillar and the motor vehicle door for rotation about the first and second pivots axes.

2. A hinge part as set forth in claim 1, wherein the hollow extruded section has more than three chambers, and wherein axially opposite outer chambers have each a cross-section suitable for connection of the hinge gudgeons.

3. A hinge part as set forth in claim 2, wherein at least two of inner chambers, which are located between the axially opposite outer chambers, have a comparatively larger cross-section.

4. A hinge part as set forth in claim 2, wherein the axially opposite outer chambers have a smaller width than inner chambers located therebetween.

5. A hinge part as set forth in claim 1, wherein the hollow extruded section extend transverse to the hinge axes.

6. A hinge part as set forth in claim 1, wherein the hollow extruded section extends parallel to the hinge axes.

7. A hinge part as set forth in claim 6, wherein axially opposite outer chambers have each a cut-out formed between respective gudgeons, which are located one above another, along a height an axial extent of the hinge part.

8. A hinge part as set forth in claim 1, wherein the hinge gudgeons are located in axially opposite outer chambers.

9. A hinge part as set forth in claim 8, wherein the hinge gudgeons are formed as shaped parts provided each with a hinge gudgeon bores.

10. A hinge part as set forth in claim 8, wherein the hinge gudgeons are formed as parts of the hinge profile.

11. A hinge part as set forth in claim 8, wherein the hinge gudgeons are formed as profiled bodies provided with hinge gudgeons bores and are inserted into free-cut regions of the axially opposite outer chambers.

12. A hinge part as set forth in claim 1, wherein the hinge gudgeons are secured to end walls of axially opposite outer chambers.

13. A hinge part as set forth in claim 1, wherein the hollow extruded section extends at an acute angle relative to at least one of the two hinge axes of the hinge part.

14. A hinge part as set forth in claim 1, wherein the hinge part body narrows toward a middle thereof in a region between axially opposite outer chambers thereof.

15. A hinge part as set forth in claim 1, wherein the chambers of the hollow extruded section are isometric.

16. A hinge part as set forth in claim 1, wherein axially opposite outer chambers of the hollow extruded section have a square cross-section, and an inner chamber, which is located between the axially opposite outer chambers, has a rectangular cross-section.

* * * * *